US011848485B2

(12) United States Patent
Huang et al.

(10) Patent No.: US 11,848,485 B2
(45) Date of Patent: Dec. 19, 2023

(54) ANTENNA MODULE

(71) Applicant: PEGATRON CORPORATION, Taipei (TW)

(72) Inventors: Chin-Ting Huang, Taipei (TW); Sony Chayadi, Taipei (TW); Hsi-Kai Hung, Taipei (TW); Chun-Kai Wang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 135 days.

(21) Appl. No.: 17/125,538

(22) Filed: Dec. 17, 2020

(65) Prior Publication Data

US 2021/0257718 A1 Aug. 19, 2021

(30) Foreign Application Priority Data

Feb. 15, 2020 (TW) ..... 109104837

(51) Int. Cl.

| | |
|---|---|
| ***H01Q 1/24*** | (2006.01) |
| ***H01Q 5/357*** | (2015.01) |
| ***H01Q 1/48*** | (2006.01) |
| ***H01Q 9/16*** | (2006.01) |

(52) U.S. Cl.

CPC ..... *H01Q 1/245* (2013.01); *H01Q 1/48* (2013.01); *H01Q 5/357* (2015.01); *H01Q 9/16* (2013.01)

(58) Field of Classification Search

CPC ..... H01Q 1/38; H01Q 5/371; H01Q 5/357; H01Q 1/2283; H01Q 1/36; H01Q 5/28; H01Q 9/42; H01Q 1/245

See application file for complete search history.

(56) References Cited

U.S. PATENT DOCUMENTS

| | | | | |
|---|---|---|---|---|
| 8,063,829 | B2 | 11/2011 | Hung et al. | |
| 2011/0260927 | A1* | 10/2011 | Wong | H01Q 1/38 343/700 MS |
| 2014/0078017 | A1* | 3/2014 | Vanjani | H01Q 5/371 343/878 |

(Continued)

FOREIGN PATENT DOCUMENTS

| | | | | |
|---|---|---|---|---|
| CN | 203260719 | | 10/2013 | |
| CN | 203260719 U | * | 10/2013 | H01Q 1/36 |

(Continued)

*Primary Examiner* — Ricardo I Magallanes

(74) *Attorney, Agent, or Firm* — J.C. PATENTS

(57) ABSTRACT

An antenna module includes a feeding end, a first radiator, a second radiator, a third radiator, and a ground structure. The first radiator excites a first frequency and a second frequency. The second radiator extends from the first radiator and excites a third frequency with a part of the first radiator. The third radiator extends from the first radiator and excites a fourth frequency with a part of the first radiator. The ground structure includes a main ground surface and an extending portion extending from the main ground surface. The main ground surface is located below the feeding end, and the extending portion extends from the main ground surface to a bottom of the first radiator and is apart from the first radiator. An extending direction of a portion of the first radiator above the extending portion is orthogonal to an extending direction of the extending portion.

9 Claims, 4 Drawing Sheets

(56) References Cited

U.S. PATENT DOCUMENTS

| | | | | |
|---|---|---|---|---|
| 2015/0116179 | A1* | 4/2015 | Mikata | H01Q 1/38<br>343/845 |
| 2015/0200457 | A1 | 7/2015 | Chan et al. | |
| 2017/0098887 | A1 | 4/2017 | Chen | |

FOREIGN PATENT DOCUMENTS

| | | |
|---|---|---|
| CN | 104604029 | 5/2017 |
| TW | I455403 | 10/2014 |
| TW | I540790 | 7/2016 |

* cited by examiner

ANTENNA MODULE

CROSS-REFERENCE TO RELATED APPLICATION

This application claims the priority benefit of Taiwan application serial no. 109104837, filed on Feb. 15, 2020. The entirety of the above-mentioned patent application is hereby incorporated by reference herein and made a part of this specification.

BACKGROUND

Technology Field

The disclosure relates to an antenna module, and particularly, to a multi-band antenna module.

Description of Related Art

At present, the operating frequencies of LTE and Sub-6 GHz for 5G communication which range from 617 MHz to 4200 MHz are considerably broad and cover multiple bands. In order to satisfy the specifications at low frequencies of 617 MHz to 960 MHz, the antenna design requires a large antenna space. Such a design improves the return loss and gain at frequencies from 1710 MHz to 4200 MHz, but the specific absorption rate (SAR) will increase and result in undesirable antenna characteristics.

SUMMARY

The disclosure provides an antenna module in which the specific absorption rate (SAR) may comply with the regulations.

An embodiment of the disclosure provides an antenna module including a feeding end, a first radiator, a second radiator, a third radiator, and a ground structure. The first radiator is adapted for exciting a first frequency and a second frequency. The second radiator extends from the first radiator and is adapted for exciting a third frequency with a part of the first radiator. The third radiator extends from the first radiator and is adapted for exciting a fourth frequency with a part of the first radiator. The ground structure includes a main ground surface and an extending portion. The main ground surface is located on a side of the feeding end, the extending portion extends from the main ground surface to a side of the first radiator and is apart from the first radiator, and an extending direction of a portion of the first radiator above the extending portion is orthogonal to an extending direction of the extending portion.

In an embodiment of the disclosure, the first radiator includes a first portion, a second portion, a third portion, a fourth portion, a fifth portion, and a sixth portion which are sequentially connected in a bent manner, the second radiator extends from the third portion of the first radiator, and the third radiator extends from the first portion of the first radiator.

In an embodiment of the disclosure, the antenna module further includes an insulation support, and the first radiator, the second radiator, and the third radiator are located on multiple surfaces of the insulation support.

In an embodiment of the disclosure, the insulation support has a first surface, a second surface, a third surface, and a fourth surface, which are configured in a stepped shape. The first surface is parallel to the third surface, the second surface is parallel to the fourth surface, the first portion is located on the first surface, the second portion is located on the second surface, the third portion and the fourth portion are located on the third surface, and the fifth portion is located on the fourth surface.

In an embodiment of the disclosure, the second radiator is located on the third surface.

In an embodiment of the disclosure, the third radiator includes a seventh portion and an eighth portion which are connected in a bent manner. The seventh portion is located on the first surface, and the eighth portion is located on the second surface.

In an embodiment of the disclosure, the insulation support has a fifth surface connected to the fourth surface. The fifth surface is opposite the first surface and the third surface, and the ground structure is located on the fifth surface.

In an embodiment of the disclosure, a width of the sixth portion is greater than a width of the fifth portion, and the sixth portion partially surrounds an outer side of the feeding end.

In an embodiment of the disclosure, a length of the first radiator is between 0.2 times and 0.3 times a wavelength of the first frequency and between 0.4 times and 0.6 times a wavelength of the second frequency, a total length of the feeding end, a part of the first radiator, and the second radiator is between 0.2 times and 0.3 times a wavelength of the third frequency, and a length of the feeding end, a part of the first radiator, and the third radiator is between 0.2 times and 0.3 times a wavelength of the fourth frequency.

In an embodiment of the disclosure, the first frequency is between 617 MHz and 960 MHz, the second frequency is between 1710 MHz and 2170 MHz, the third frequency is between 2300 MHz and 2690 MHz, and the fourth frequency is between 3300 MHz and 4200 MHz.

Based on the above, in the antenna module of the disclosure, the first radiator excites the first frequency and the second frequency, the second radiator and a part of the first radiator excite the third frequency, and the third radiator and a part of the first radiator excite the fourth frequency. Therefore, the antenna module of the disclosure exhibits broadband and multi-band effects. In addition, the extending portion of the ground structure of the antenna module of the disclosure extends to below the first radiator and is apart from the first radiator, and the extending direction of the portion of the first radiator above the extending portion is orthogonal to the extending direction of the extending portion. With this design, the currents flowing through the extending portion and the portion above are at 90 degrees and interfere with each other to thereby change the specific absorption rate (SAR) of the antenna module so that the specific absorption rate (SAR) can comply with the regulations. In addition, with this design, the antenna module also has good performance in terms of the return loss.

To make the aforementioned more comprehensible, several embodiments accompanied with drawings are described in detail as follows.

DESCRIPTION OF THE EMBODIMENTS

Figure 1:
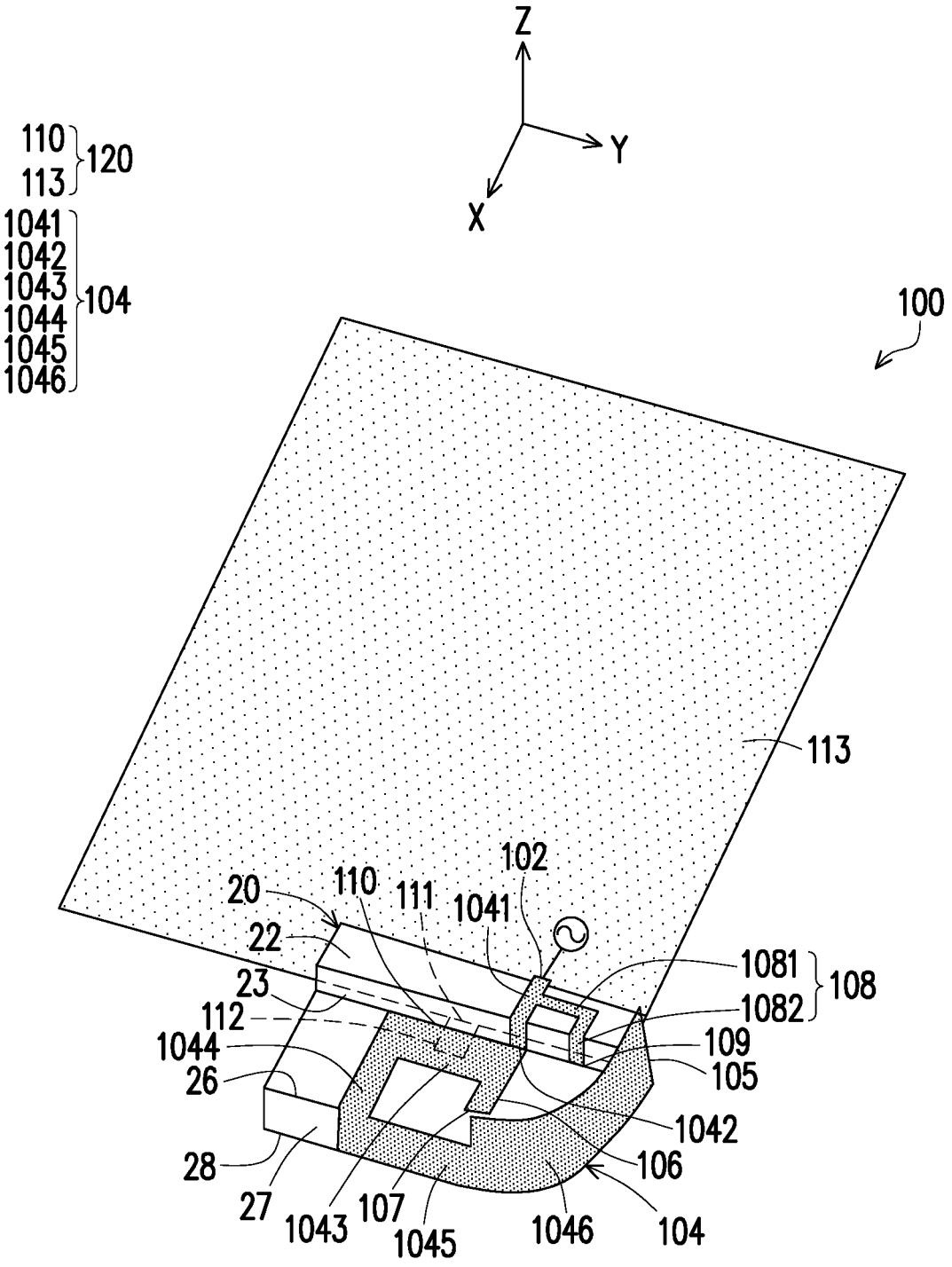
FIG. 1 is a schematic view of an antenna module according to an embodiment of the disclosure.

FIG. 1 is a schematic view of an antenna module according to an embodiment of the disclosure. Referring to FIG. 1, an antenna module 100 of this embodiment includes a feeding end 102, a first radiator 104, a second radiator 106, a third radiator 108, and a ground structure 120.

The first radiator 104 is adapted for exciting a first frequency and a second frequency. Specifically, the first radiator 104 includes a first portion 1041, a second portion 1042, a third portion 1043, a fourth portion 1044, a fifth portion 1045, and a sixth portion 1046 which are sequentially connected in a bent manner.

The length of the first radiator 104 (i.e., the distance from the feeding end 102 to an open end 105) is between 0.2 times and 0.3 times the wavelength of the first frequency, for example, 0.25 times the wavelength. The length of the first radiator 104 is between 0.4 times and 0.6 times the wavelength of the second frequency, for example, 0.5 times the wavelength.

In this embodiment, the first frequency is between 617 MHz and 960 MHz (e.g., LTE band 12), and the second frequency is between 1710 MHz and 2170 MHz (e.g., LTE band 2). Of course, the first frequency and the second frequency are not limited thereto.

In addition, in this embodiment, the antenna module 100 further includes an insulation support 20, and the first radiator 104, the second radiator 106, and the third radiator 108 are disposed on multiple surfaces of the insulation support 20. Specifically, the insulation support 20 has a first surface 22, a second surface 23, a third surface 26, and a fourth surface 27, which are configured in a stepped shape. The first surface 22 is parallel to the third surface 26, the second surface 23 is parallel to the fourth surface 27, the second surface 23 is perpendicular to the first surface 22 and the third surface 26, and the third surface 26 is perpendicular to the fourth surface 27.

In this embodiment, the first portion 1041 of the first radiator 104 is located on the first surface 22, and the second portion 1042 is located on the second surface 23. The third portion 1043 and the fourth portion 1044 are located on the third surface 26, and the fifth portion 1045 is located on the fourth surface 27.

As shown in FIG. 1, in this embodiment, the width of the sixth portion 1046 is greater than the width of the fifth portion 1045, and the sixth portion 1046 partially surrounds the outer side of the feeding end 102. Since the SAR value of the feeding end 102 is relatively large, the sixth portion 1046 surrounding the partial outer side of the feeding end 102 may be used to reduce the SAR value on the outer side of the sixth portion 1046.

On the other hand, the second radiator 106 extends from the third portion 1043 of the first radiator 104 and is located on the third surface 26. The second radiator 106 is adapted for exciting a third frequency with a part of the first radiator 104. Specifically, the total length of the portion extending from the feeding end 102, the first portion 1041 and the second portion 1042 of the first radiator 104, to an open end 107 of the second radiator 106 is between 0.2 times and 0.3 times the wavelength of the third frequency, for example, 0.25 times the wavelength. In this embodiment, the third frequency is between 2300 MHz and 2690 MHz (e.g., LTE band 30). Of course, the third frequency is not limited thereto.

In addition, the third radiator 108 extends from the first portion 1041 of the first radiator 104 and is adapted for exciting a fourth frequency with a part of the first radiator 104. The third radiator 108 includes a seventh portion 1081 and an eighth portion 1082 which are connected in a bent manner. The seventh portion 1081 is located on the first surface 22, and the eighth portion 1082 is located on the second surface 23.

The total length of the portion extending from the feeding end 102, a part of the first portion 1041 of the first radiator 104, the seventh portion 1081 and the eighth portion 1082 of the third radiator 108, to an open end 109 is between 0.2 times and 0.3 times the wavelength of the fourth frequency, for example, 0.25 times the wavelength. In this embodiment, the fourth frequency is between 3300 MHz and 4200 MHz (e.g., 5G band N77). Of course, the fourth frequency is not limited thereto.

In this embodiment, the sixth portion 1046 of the first radiator 104 may surround the second radiator 106 and the third radiator 108. Such design can reduce the electromagnetic radiation energy excited by the second radiator 106 and the third radiator 108 which radiates toward the sixth portion 1046, thereby reducing the SAR value on the outer side of the sixth portion.

As shown in FIG. 1, in this embodiment, the first radiator 104, the second radiator 106, and the third radiator 108 are located on different surfaces of the insulation support 20. Such design can balance the specific absorption rates (SAR) in the positive Z direction and the negative Z direction and thereby reduces the specific absorption rate (SAR).

Since the operating frequency of the antenna module 100 of this embodiment covers a range from 617 MHz to 4200 MHz, the antenna module 100 of this embodiment can cover the wireless communication frequency LTE full band/WCDMA/Sub-6 GHz and has broadband and multi-band performance.

It is noted that, in this embodiment, the ground structure 120 includes a main ground surface 113 and an extending portion 110 extending from the main ground surface 113. A first end 111 of the extending portion 110 is connected to the main ground surface 113, and a second end 112 of the extending portion 110 is an open end. The main ground surface 113 is located below the feeding end 102. Specifically, in this embodiment, the insulation support 20 has a fifth surface 28 (bottom surface) connected to the fourth surface 27. The fifth surface 28 is opposite the first surface 22 and the third surface 26. The main ground surface 113 and the extending portion 110 of the ground structure 120 are disposed on the fifth surface 28.

In this embodiment, the extending portion 110 extends from the main ground surface 113 to the bottom of the third portion 1043 of the first radiator 104. Since the extending portion 110 is located on the fifth surface 28 of the insulation support 20, and the third portion 1043 of the first radiator 104 is located on the third surface 26 of the insulation support 20, the extending portion 110 of the ground structure 120 is disposed apart from the third portion 1043 of the first radiator 104.

In addition, the extending direction (i.e., the Y direction) of the portion (i.e., the third portion 1043) of the first radiator 104 located above the extending portion 110 is orthogonal to the extending direction (i.e., the X direction) of the extending portion 110. Therefore, the currents flowing through the extending portion 110 of the ground structure 120 and the third portion 1043 of the first radiator 104 intersect by 90 degrees and interfere with each other, and thereby the return loss (S11) characteristics and the SAR value of the antenna module 100 can be adjusted. Therefore, the antenna module 100 of this embodiment has good return loss (S11) characteristics and SAR value performance, and may be able to have a contact with the human body and is suitable for handheld communication devices.

Since the distance between the first radiator 104 and the extending portion 110 may be determined by the distance between the third surface 26 and the fifth surface 28 of the insulation support 20 (i.e., the thickness of a partial region of the insulation support 20), the designer may select the insulation support 20 in a different size according to the requirements to change the distance between the first radiator 104 and the extending portion 110, and thereby adjust the return loss (S11) characteristics and the SAR value of the antenna module 100. In addition, in an embodiment, an RF circuit, a baseband circuit, a screen, a battery, or other electronic components may be disposed on the main ground surface 113.

Table 1 below shows SAR values measured by using the Dasy system developed by Schmid & Partner Engineering AG (SPEAG). According to FCC regulations, the 1 g SAR value on six sides of an antenna module shall not exceed 1.6 (mW/g). In Table 1, the SAR values of the antenna module 100 in this embodiment are compared with the SAR values of an antenna module (labeled as 10 in FIG. 2 to FIG. 6) without the extending portion 110.

According to Table 1, at the operating frequency of 1880 MHz, on the test planes of the positive Z axis and the negative Z axis, the SAR value may be reduced by up to 28%. The antenna module 100 of this embodiment complies with the SAR value regulations of the FCC, and the 1 g SAR value does not exceed 1.6 (mW/g) on all six sides. Compared with the antenna module 10 without the extending portion 110, the antenna module 100 of this embodiment has better performance.

Figure 2:
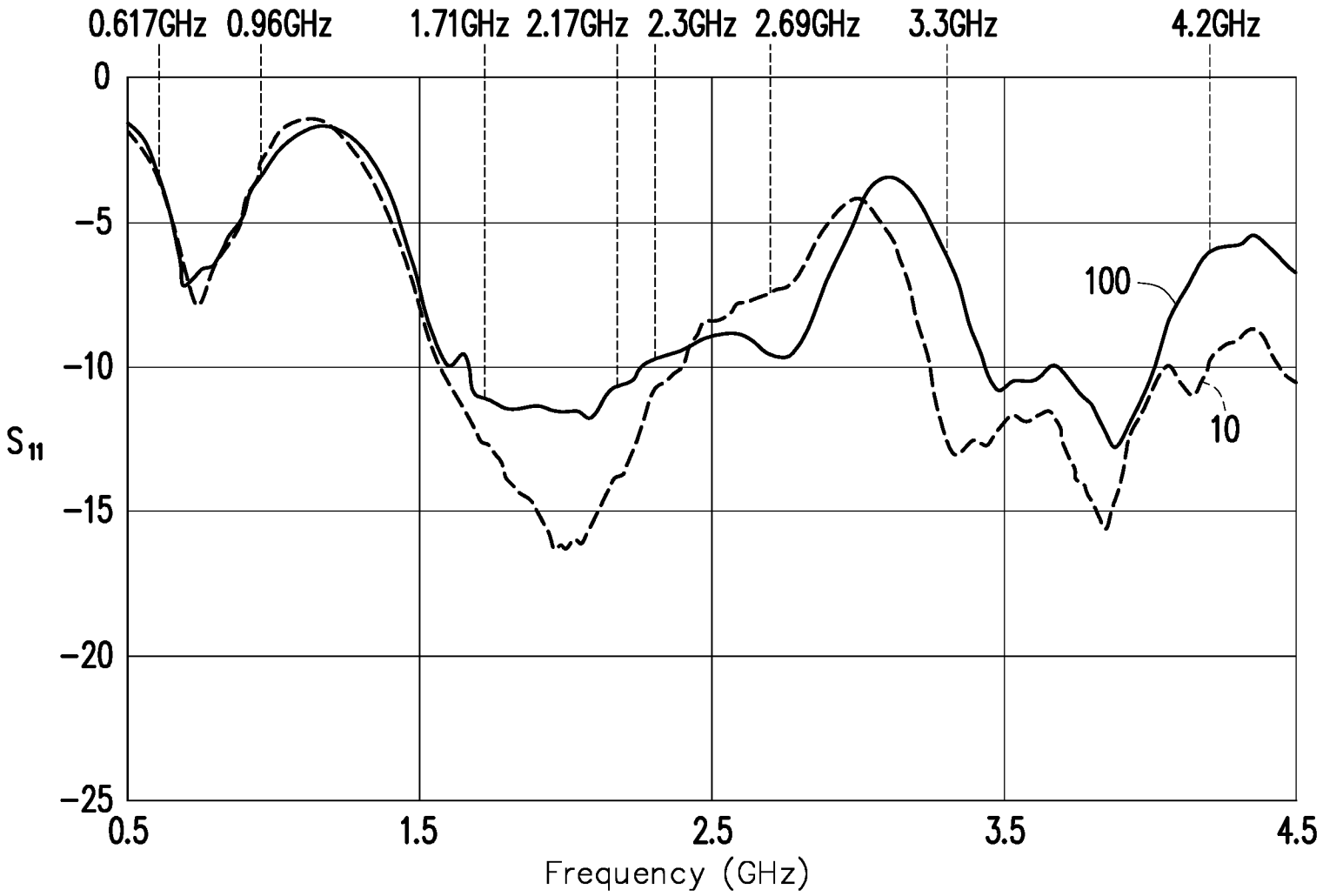
FIG. 2 is a frequency vs. the return loss (S11) graph for the antenna module of FIG. 1, and the antenna module without the extending portion.

FIG. 2 is a frequency vs. return loss (S11) graph for the antenna module (labeled as 100) of FIG. 1 and the antenna module (labeled as 10) without the extending portion. Referring to FIG. 2, the return loss (S11) of the antenna module 100 of this embodiment may be less than −4, and the antenna module 100 of this embodiment has a good performance.

Figure 3:
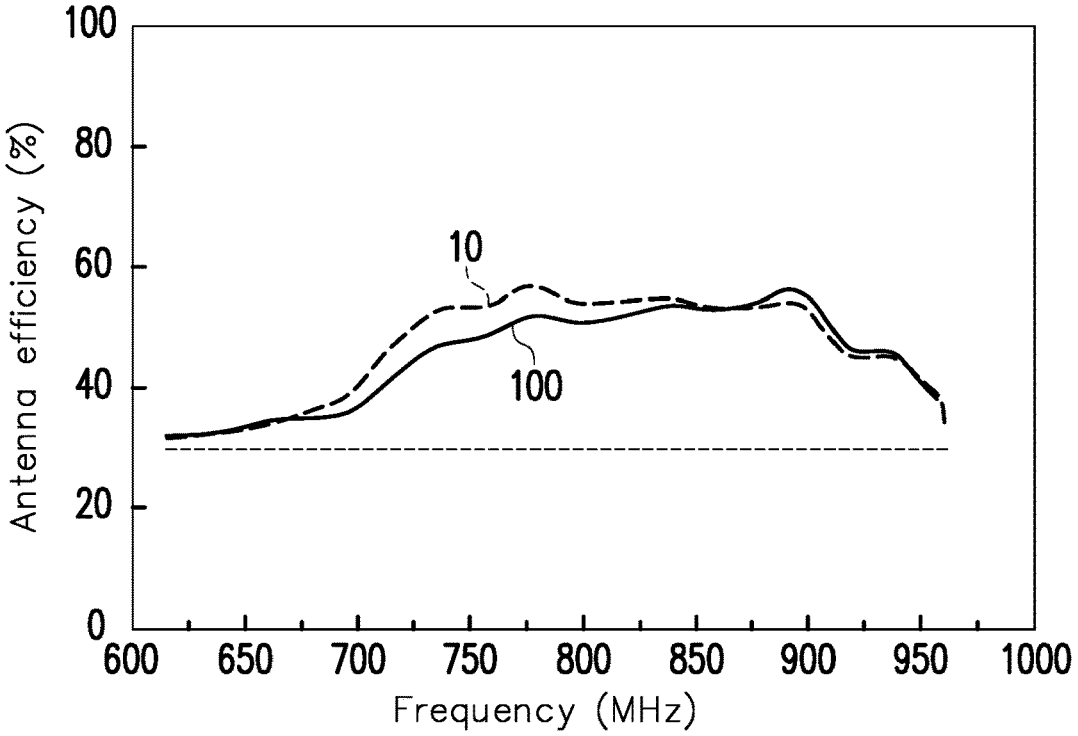
FIG. 3 is a plot of antenna efficiency at the first frequency for the antenna module of FIG. 1, and the antenna module without the extending portion.
Figure 4:
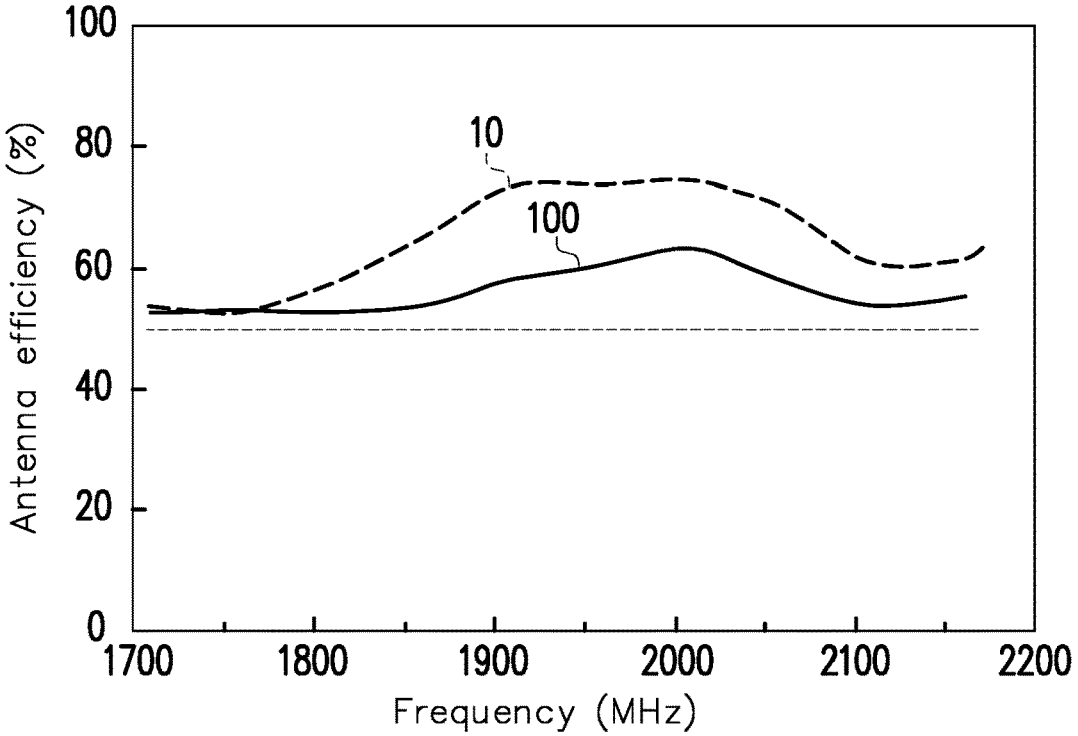
FIG. 4 is a plot of antenna efficiency at the second frequency for the antenna module of FIG. 1, and the antenna module without the extending portion.
Figure 5:
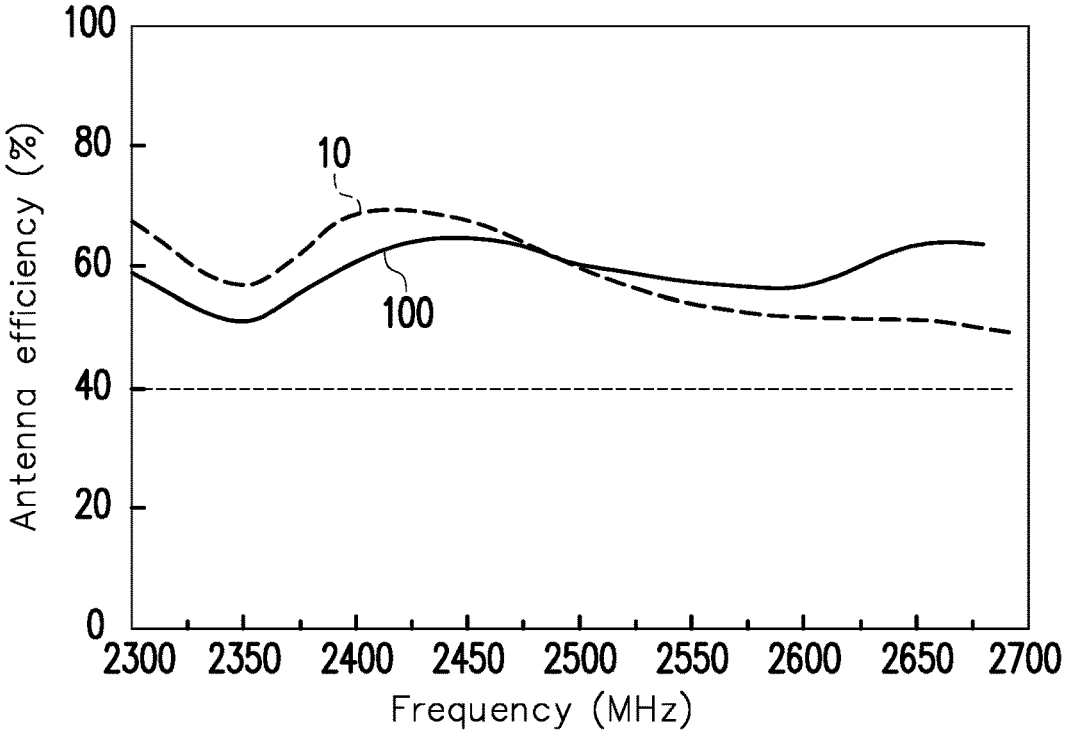
FIG. 5 is a plot of antenna efficiency at the third frequency for the antenna module of FIG. 1, and the antenna module without the extending portion.
Figure 6:
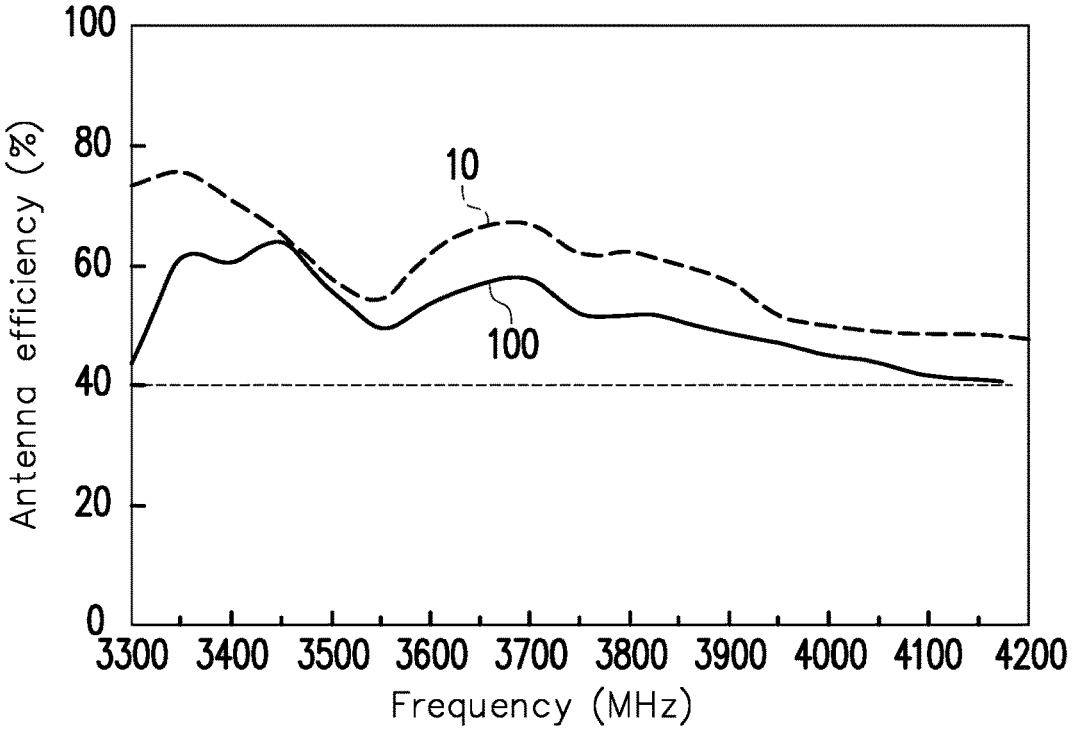
FIG. 6 is a plot of antenna efficiency at the fourth frequency for the antenna module of FIG. 1, and the antenna module without the extending portion.

FIG. 3 is a plot of antenna efficiency at the first frequency for the antenna module (labeled as 100) of FIG. 1 and the antenna module (labeled as 10) without the extending portion. FIG. 4 is a plot of antenna efficiency at the second frequency for the antenna module (labeled as 100) of FIG. 1 and the antenna module (labeled as 10) without the extending portion. FIG. 5 is a plot of antenna efficiency at the third frequency for the antenna module (labeled as 100) of FIG. 1 and the antenna module (labeled as 10) without the extending portion. FIG. 6 is a plot of antenna efficiency at the fourth frequency for the antenna module (labeled as 100) of FIG. 1 and the antenna module (labeled as 10) without the extending portion. Referring to FIG. 3 to FIG. 6, the antenna efficiency of the antenna module 100 of this embodiment is higher than 40% from 617 MHz to 4200 MHz, and the antenna module 100 of this embodiment has good performance.

According to Table 1 and FIG. 2 to FIG. 6, although the antenna module 10 without the extending portion 110 has good performance in terms of the return loss (S11) and the antenna efficiency, its specific absorption rate (SAR) does not comply with the specified value. Compared with the antenna module 10 without the extending portion 110, the antenna module 100 of this embodiment has good performance in terms of any of the return loss (S11), the antenna efficiency, and the specific absorption rate (SAR).

In summary of the above, in the antenna module of the disclosure, the first radiator excites the first frequency and the second frequency, the second radiator and a part of the first radiator excite the third frequency, and the third radiator and a part of the first radiator excite the fourth frequency. Therefore, the antenna module of the disclosure exhibits broadband and multi-band effects. In addition, the extending portion of the ground structure of the antenna module of the

TABLE 1

| Frequency | Test position plane | Spacing (mm) | Operating frequency (MHz) | Input power (dBm) | Antenna module 100 1 g SAR (mW/g) | Antenna module 10 without extending portion 110 1 g SAR (mW/g) |
|---|---|---|---|---|---|---|
| LTE 2 | Positive Z axis | 10 | 1880 | 24 | 1.20 | 1.67 |
| | Negative Z axis | | | | 1.21 | 1.69 |
| | Positive X axis | | | | 0.93 | 1.12 |
| | Positive Y axis | | | | 0.74 | 0.86 |
| | Negative X axis | | | | 0.00 | 0.00 |
| | Negative Y axis | | | | 0.00 | 0.00 |
| LTE 30 | Positive Z axis | 10 | 2310 | 24 | 1.06 | 1.41 |
| | Negative Z axis | | | | 1.38 | 1.71 |
| | Positive X axis | | | | 0.62 | 0.81 |
| | Positive Y axis | | | | 0.61 | 0.81 |
| | Negative X axis | | | | 0.00 | 0.00 |
| | Negative Y axis | | | | 0.00 | 0.00 |
| LTE 12 | Positive Z axis | 10 | 707.5 | 24 | 0.92 | 0.93 |
| | Negative Z axis | | | | 0.91 | 0.92 |
| | Positive X axis | | | | 1.19 | 1.11 |
| | Positive Y axis | | | | 1.24 | 1.34 |
| | Negative X axis | | | | 0.00 | 0.00 |
| | Negative Y axis | | | | 0.00 | 0.00 |
| N77 | Positive Z axis | 10 | 4200 | 24 | 0.97 | 1.13 |
| | Negative Z axis | | | | 1.06 | 1.18 |
| | Positive X axis | | | | 0.62 | 0.71 |
| | Positive Y axis | | | | 0.32 | 0.38 |
| | Negative X axis | | | | 0.00 | 0.00 |
| | Negative Y axis | | | | 0.00 | 0.00 |

disclosure extends to the bottom of the first radiator and is apart from the first radiator. The extending direction of the portion of the first radiator above the extending portion is orthogonal to the extending direction of the extending portion. With this design, the currents flowing through the extending portion and the portion above form 90 degrees and interfere with each other, which changes the specific absorption rate (SAR) of the antenna module. Therefore, the specific absorption rate (SAR) can comply with the regulations. In addition, with this design, the antenna module also has good performance in terms of the return loss.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An antenna module comprising:

a feeding end;

a first radiator adapted for exciting a first frequency range and a second frequency range;

a second radiator extending from the first radiator and adapted for exciting a third frequency range with a part of the first radiator;

a third radiator extending from the first radiator and adapted for exciting a fourth frequency range with a part of the first radiator;

a ground structure comprising a main ground surface and an extending portion, wherein the main ground surface is located on a side of the feeding end, the extending portion extends from the main ground surface to a side of the first radiator and is apart from the first radiator, and an extending direction of a portion of the first radiator corresponding to the extending portion is orthogonal to an extending direction of the extending portion; and an insulation support, wherein each of the first radiator, the second radiator, and the third radiator is located on different surfaces of the insulation support to balance specific absorption rates (SAR) in a positive Z direction and a negative Z direction.

2. The antenna module according to claim 1, wherein the first radiator comprises a first portion, a second portion, a third portion, a fourth portion, a fifth portion, and a sixth portion which are sequentially connected in a bent manner, the second radiator extends from the third portion of the first radiator, and the third radiator extends from the first portion of the first radiator.

3. The antenna module according to claim 2, wherein the insulation support has a first surface, a second surface, a third surface, and a fourth surface which are configured in a stepped shape, wherein the first surface is parallel to the third surface, the second surface is parallel to the fourth surface, the first portion is located on the first surface, the second portion is located on the second surface, the third portion and the fourth portion are located on the third surface, and the fifth portion is located on the fourth surface.

4. The antenna module according to claim 3, wherein the second radiator is located on the third surface.

5. The antenna module according to claim 3, wherein the third radiator comprises a seventh portion and an eighth portion which are connected in a bent manner, wherein the seventh portion is located on the first surface, and the eighth portion is located on the second surface.

6. The antenna module according to claim 3, wherein the insulation support has a fifth surface connected to the fourth surface, the fifth surface is opposite the first surface and the third surface, and the ground structure is located on the fifth surface.

7. The antenna module according to claim 2, wherein a width of the sixth portion is greater than a width of the fifth portion, and the sixth portion partially surrounds an outer side of the feeding end.

8. The antenna module according to claim 1, wherein a length of the first radiator is between 0.2 times and 0.3 times a wavelength of the first frequency range, and between 0.4 times and 0.6 times a wavelength of the second frequency range, a total length of the feeding end, a part of the first radiator, and the second radiator is between 0.2 times and 0.3 times a wavelength of the third frequency range, and a length of the feeding end, a part of the first radiator, and the third radiator is between 0.2 times and 0.3 times a wavelength of the fourth frequency range.

9. The antenna module according to claim 1, wherein the first frequency range is between 617 MHz and 960 MHz, the second frequency range is between 1710 MHz and 2170 MHz, the third frequency range is between 2300 MHz and 2690 MHz, and the fourth frequency range is between 3300 MHz and 4200 MHz.

* * * * *